United States Patent [19]

Feldkämper

[11] 4,264,317

[45] Apr. 28, 1981

[54] METHOD OF MAKING VALVED SACKS PROVIDED WITH CROSS-BOTTOMS

[75] Inventor: Richard Feldkämper, Lengerich, Fed. Rep. of Germany

[73] Assignee: Windmoller & Holscher, Lengerich, Fed. Rep. of Germany

[21] Appl. No.: 53,334

[22] Filed: Jun. 29, 1979

[30] Foreign Application Priority Data

Jul. 14, 1978 [DE] Fed. Rep. of Germany ..... 2831036

[51] Int. Cl.[3] ..... B31B 1/84; B31B 23/00

[52] U.S. Cl. ..... 493/213; 493/219; 493/224; 493/235; 493/267

[58] Field of Search ..... 93/35 SB, 35 R, 8 VB, 93/8 WA, 8 R

[56] References Cited

U.S. PATENT DOCUMENTS

| | | | |
|---|---|---|---|
| 3,195,424 | 7/1965 | Camerini | 93/35 R |
| 3,473,446 | 10/1969 | Bergheracht | 93/35 R |
| 3,611,883 | 10/1971 | Grob | 93/8 WA |
| 3,853,040 | 12/1974 | Achelpohl | 93/8 VB X |
| 3,974,747 | 8/1976 | Tsukino | 93/8 VB |

FOREIGN PATENT DOCUMENTS

| | | | |
|---|---|---|---|
| 1250249 | 9/1967 | Fed. Rep. of Germany | 93/8 VB |
| 2362613 | 6/1975 | Fed. Rep. of Germany | 93/8 VB |

*Primary Examiner*—James F. Coan

*Attorney, Agent, or Firm*—Fleit & Jacobson

[57] ABSTRACT

A web of bag-making material has longitudinally folded rectangular sheets adhered at intervals to one face by one flap before longitudinal margins of the web are folded over, stuck to the other flap of each sheet and joined where they overlap to define a tube, whereafter sections are severed from the tube to make bags to be formed with cross-bottom closures at the ends. The size and position of each folded sheet is such that it will subsequently form an internal seal for the respective cross-bottom closure but the sheet for the closure at one end is made as two longitudinally aligned segments of which one segment has been transversely pre-folded back onto itself to define a tab adjacent the edge of the other segment with the length of a subsequent filling valve for the bag. Following formation of the cross-bottom closures, the filling valve is formed by unfolding the pre-folded tab.

4 Claims, 4 Drawing Figures

METHOD OF MAKING VALVED SACKS PROVIDED WITH CROSS-BOTTOMS

The invention relates to a method of making valved sacks provided with cross-bottoms, wherein a web of material is converted to a flattened tubular web by folding over the side portions, of which the overlapping margins are interconnected by a longitudinal seam, tube sections are severed from said tubular web, and the ends of the tube sections are formed with bases by being pulled open and folded inwardly and by the resulting overlapping side flaps being cemented together with the incorporation of the adjoining angles of the corner folds, folded labels which define internal locks, are longer than the spacing between the bases of the subsequent corner folds and wider than the subsequent base width being applied to the as yet open web with the fold lines facing the subsequent middle of the bag, the lower portions of the folded labels being cemented thereon along their outer margin at a position adjoining or behind the subsequent lines of cut for severing the tube sections, and the upper marginal portion of the folded labels or the side portions of the web coming into contact therewith after folding over being provided with applications of adhesive so that it adheres to the side portions of the web after these have been of olded over to form one wall of the sack, according to German patent application No. P 28 11 857.2.

Trickle-proof cross-bottoms can be made by the method according to the parent patent. However, if sacks are being made with cross-bottoms at both ends, one bottom must be provided with a filling valve. For this purpose the method of the parent patent provides for one of the folded labels defining the internal locks being provided at right-angles to its fold line with an incision substantially corresponding to the subsequent base width for introducing the valve.

It is the problem of the present invention to develop the method of the parent patent such that the trickle-proof cross-bottoms made thereby can be easily provided with filling valves.

According to the invention, this problem is solved in that the label is applied as two aligned label portions of which the first has, prior to being folded, already been folded onto itself about a fold line at right-angles to the fold line and by a length corresponding to the subsequent valve length so that the part turned over by this first folding is disposed in the fold formed by the second folding, that the doubly folded label portion is so applied to the web that the fold line formed by the first folding is disposed in front of the parallel edge of the corner fold that faces the middle of the sack, that the second label portion consists of a label which is folded once and the inner severed edge of which adjoins, with a gap, the fold line of the first label portion formed by the first folding, and that after pulling the base open the part turned over by the first folding is turned over onto the corner fold. By the method of the invention, the internal lock is formed by two juxtaposed folded labels, one of the labels having a flap which consists of the turned-over part and which, after being folded back onto the corner fold, defines the filling valve therewith. The two labels forming the internal lock can be applied to the web of material so that they abut, form a gap therebetween or overlap each other. All that is important is that a mouth for the valve is defined by a slit between the second label portion and the unfolded flap of the first label portion.

The flap formed by the turned-over part of the first label portion is preferably made so long that it projects beyond the side folds.

The parts of the flap projecting beyond the fold lines of the base about which the side folds are folded may be provided with applications of adhesive to facilitate good adhesion to the base. For the purpose, after pulling the base open and before turning the part formed by the first folding over onto the corner fold, its portions lying on the side folds can be provided with applications of adhesive.

In another embodiment of the invention, after pulling the base open and before turning over the part of the first label portion, a valve consisting of a tube section may be adhered to the corner folds.

An example of the invention will now be described in more detail with reference to the drawing, wherein.

Figure 1:
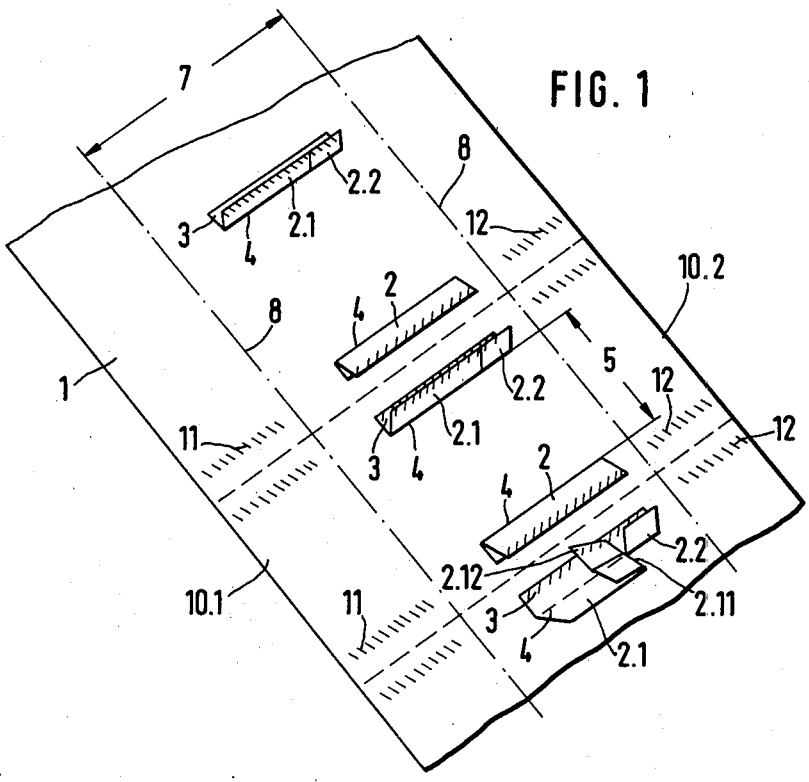
FIG. 1 is a perspective view of part of the as yet flat web of material having folded labels stuck thereto that later form the internal lock.

Internal locks 2 or 2.1 and 2.2 are applied at intervals to a web 1 of kraft paper or consisting of a plurality of layers of which the innermost layer can be coated on the inside so that a trickle-proof sack can be formed therefrom. The internal locks are folded centrally upon themselves parallel to their longitudinal side and they are applied by means of an adhesive strip 3 running closely adjacent their first longitudinal edge, their fold lines 4 being directed towards each other in pairs and the internal spacing of the internal locks 2 from the internal locks 2.1 and 2.2 corresponding to the mutual spacing 5 of the subsequent bases of the sack 6. The internal lock 2.1 has its fold line 2.11 disposed closely adjacent the narrow side of the internal lock 2.2.

The internal locks 2 or 2.1 and 2.2 are centrally disposed on the web 1 in the region 7 which later forms one wall of the sacks. The internal locks 2.1 are folded back onto themselves by a certain length about a fold line 2.11 adjacent the internal lock 2.1, the length of this folded-over part 2.12 corresponding to the length of the subsequent valve. The one internal lock 2.1 is shown in FIG. 1 in an almost unfolded position to make its construction clear. Adhesive strips 11, 12 are applied to the web 1 in the region of a wall 10 consisting of the web portions 10.1 and 10.2 which are to be folded about fold lines 8 during tube formation and closed by a longitudinal seam 9. By means of the adhesive strips 11, 12, the second longitudinal edges of the internal locks 2 or 2.1 and 2.2 are connected to the wall 10 during formation of the tube.

Figure 2:
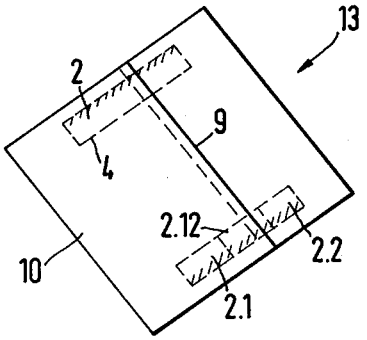
FIG. 2 is a plan view of a tube section severed from the tubular web formed from the web according to FIG. 1.

FIG. 2 illustrates a tube section 13 which has been severed along the broken line shown in FIG. 1 from a tubular web formed from the web illustrated in FIG. 1. For the purpose of forming side flaps having rectangular portions, the tubular web section 13 is on each side provided with two axially extending incisions.

Figure 3:
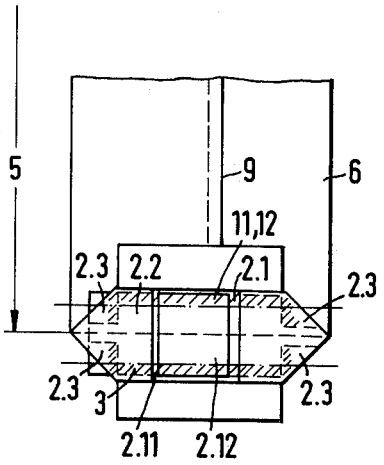
FIG. 3 is a plan view of one end of the tube section with the base pulled open and FIG. 4 is a plan view of a different embodiment of the cross-bottom formation with inserted valve.

FIG. 3 shows the end region of a tube section according to FIG. 2 with a base that has been pulled open. However, the base of the sack 6 according to FIG. 3 can, as in German application No. P 28 11 857.2-27 possess a longer internal lock 2 or longer internal locks 2.1 and 2.2 in comprison with FIGS. 1 and 2. It will be clear that the corners 2.3 of the internal locks are folded in with the corner folds. The longer the internal locks, i.e. the more closely they approach the fold lines 8, the shorter will be the gap which remains in the apices of the corner folds and which is not covered by the internal locks. In the case of sacks with such internal locks, a very efficient seal for the bases is achieved as has already been pointed out in the German application No. P 28 11 857.2-27. After the base has been pulled open, the part 2.12 folded onto the internal lock 2.1 is unfolded about the fold line 2.11 after it, as well as the corresponding parts of the base itself, had been provided with adhesive and it is adhered to the underlying corner fold. The valve is formed by the corner fold and the part 2.12.

When adhering the folded internal locks 2 to the as yet open web 1, care should be taken that the adhesive applications 3 and 11, 12 are disposed on the side flaps beyond the base fold lines shown in chain-dotted lines in FIG. 3.

The fold line 4 of the internal locks 2 lies on the line which subsequently connects the outer angles of the corner folds and which is shown in broken lines in FIG. 3, so that the internal lock lies flat in the pulled-open base up to its portions folded together with the corner folds.

Figure 4:
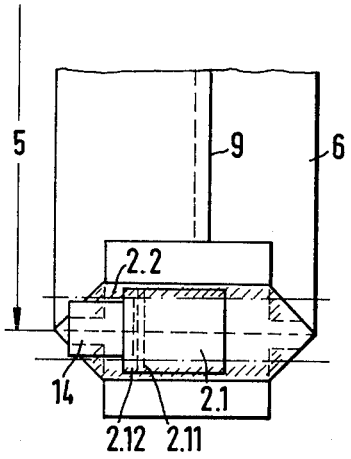

FIG. 4 shows a modification of the invention. In this case the turned-over part 2.12 is somewhat shorter and a valve 14 is adhered to the corner fold. The part 2.12 is stuck to the corner fold or the valve after its side edges have had adhesive applied to them. When employing coated paper for the inner sack layer and the internal locks 2, 2.1 and 2.2 and possibly also for the valve 14, a substantially trickle-proof sack can be made.

I claim:

1. A method of making valved sacks provided with cross-bottoms, comprising converting a web of material to a flattened tubular web by folding over side portions of the web onto a central portion so that overlapping margins of the side portions are interconnected by a longitudinal seam, forming tube sections with bases by cutting the tubular web to form individual sections and pulling open the section to form cornerfolds and folding inwardly the corner folds and cementing together the resulting overlapping side flaps with the incorporation of adjoining angles of the corner folds, applying labels folded about first fold lines which define internal locks, are longer than the spacing between the bases of the subsequent corner folds and wider than the subsequent base width to the as yet open web with the first fold lines facing the subsequent middle of the bag, cementing a lower portion of one of the folded labels on an upper portion of the web along its outer margin at a position adjoining or behind a subsequent line of cut for severing the top of the tube section, cementing a lower portion of a second of the folded labels on a lower portion of the web along its outer margin at a position adjoining or behind a subsequent line of cut for severing the bottom of the tube section, and providing applications of adhesive on upper marginal portions of the folded labels or the side portions of the web coming into contact therewith after folding over so that the labels adhere to the side portions of the web after these have been folded over to form one wall of the sack, the second folded label being applied as two aligned label portions of which the first portion has, prior to being folded about said first fold line, already been folded onto itself about a second fold line at right-angles to the first fold line and by a length corresponding to a subsequent valve length so that a part of the first portion turned over by the folding about the second fold line is disposed in the fold formed by the first fold line, the doubly folded first portion is so applied to the web that the second fold line is disposed in front of parallel edges of adjacent corner folds of the second label that face the middle of the sack, a second portion of the second folded label comprises a label which is folded once and has an inner severed edge which adjoins, with a gap, the second fold line of the first portion so that after pulling the base open, the part of the first portion turned over the second fold line is turned over onto the adjacent corner folds.

2. A method according to claim 1, characterized in that, after pulling the base open and before turning the part of the first portion formed by the folding about the second fold line over onto the adjacent corner folds, portions of the first portion lying on side folds of the sack are provided with applications of adhesive.

3. A method according to claim 1 or claim 2, characterized in that, after pulling the base open and before turning over the part of the first portion, a valve consisting of a tube section is adhered to the adjacent corner folds.

4. A method of making sacks provided with cross bottoms comprising:

folding over side portions of a web of material so that margins of the side portions overlap and the web forms a flattened tubular web;

interconnecting the overlapping margins with a longitudinal seam;

severing individual tube sections from the tubular web;

forming top and bottom bases for an individual tube section by inwardly folding opposed portions of the top and bottom of the tube section to define triangular-shaped corner folds having parallel bases spaced from each other with corresponding ends of the parallel bases defining side flaps, folding inwardly the side flaps so that a portion of one side flap overlaps a portion of the other, and interconnecting the overlapping portions of the side flaps to each other;

applying a first label folded along a fold line to a central portion of the web of material that subsequently forms an upper part of a sack formed from the web prior to the folding of the side portions thereof, the first label after formation of the top base of an individual tube section defining a first internal lock, securing the first label to the central portion of the web of material prior to folding over the side portions, and securing the first label to the side portions after folding thereof; and applying a second label having two aligned label portions folded along a first fold line to a central portion of the web of material that subsequently forms a lower part of a sack, a first of the label portions being folded onto itself about a second fold line extending at right angles to the first fold line prior to folding of the first portion about the first fold line, the part of the first portion folded over the second fold line being double folded and having a length corresponding to a subsequent valve length, formed from the web prior to the folding of the side portions thereof, the second label after formation of the bottom base of an individual tube section defining a second internal lock, securing the label portions of said second label to the central portion of the web of material prior to folding over of the side portions in such manner that the label portions have a space therebetween and the second fold line is parallel to adjacent edges of the corner fold, and securing the second label to the side portions after folding thereof with the folded over part of the first portion being turned over onto the adjacent corner folds, the first and second labels having lengths sufficient to cover the spaces between the parallel bases of the corner folds and being applied to the web of material in positions to at least partially close the spaces after formation of the top and bottom bases of the individual tube section.

* * * * *